US008932148B2

(12) United States Patent
Presse, IV et al.

(10) Patent No.: US 8,932,148 B2
(45) **Date of Patent: *Jan. 13, 2015**

(54) ELLIPTICAL GOLF CLUB GRIP

(71) Applicants: Bill Presse, IV, Reno, NV (US); Scott Sulprizio, Carson City, NV (US)

(72) Inventors: Bill Presse, IV, Reno, NV (US); Scott Sulprizio, Carson City, NV (US)

(73) Assignees: Bill Presse, IV, Reno, NV (US); Scott Sulprizio, Carson City, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/219,929

(22) Filed: Mar. 19, 2014

(65) Prior Publication Data

US 2014/0315656 A1 Oct. 23, 2014

Related U.S. Application Data

(63) Continuation-in-part of application No. 13/865,708, filed on Apr. 18, 2013.

(51) Int. Cl.
*A63B 53/02* (2006.01)

(52) U.S. Cl.
USPC ..... 473/314; 473/340

(58) Field of Classification Search
USPC ..... 473/340–341, 314, 313
See application file for complete search history.

(56) References Cited

U.S. PATENT DOCUMENTS

| | | | | |
|---|---|---|---|---|
| 1,631,504 | A * | 6/1927 | Redman | 473/313 |
| 4,310,158 | A * | 1/1982 | Hoffman | 473/204 |
| 5,454,564 | A * | 10/1995 | Kronogard | 473/201 |
| 5,460,372 | A * | 10/1995 | Cook | 473/204 |
| 5,728,009 | A * | 3/1998 | Shanahan | 473/313 |
| 6,152,832 | A * | 11/2000 | Chandler, III | 473/293 |
| 7,066,829 | B1 * | 6/2006 | Lister | 473/314 |
| 7,121,954 | B2 * | 10/2006 | Charron et al. | 473/293 |
| 7,524,247 | B2 * | 4/2009 | Williams | 473/223 |
| 7,635,310 | B2 * | 12/2009 | Keough | 473/297 |
| 8,734,266 | B2 * | 5/2014 | David | 473/251 |
| 2002/0151376 | A1 * | 10/2002 | Verne | 473/314 |
| 2006/0142094 | A1 * | 6/2006 | McCracken | 473/313 |
| 2006/0199663 | A1 * | 9/2006 | Lister | 473/340 |
| 2007/0026959 | A1 * | 2/2007 | Boone | 473/300 |
| 2012/0214610 | A1 * | 8/2012 | Parsons | 473/303 |
| 2013/0130825 | A1 * | 5/2013 | McLoughlin | 473/303 |

FOREIGN PATENT DOCUMENTS

| | | | | |
|---|---|---|---|---|
| GB | 2362832 | A * | 12/2001 | A63B 53/00 |

* cited by examiner

*Primary Examiner* — Stephen L. Blau
(74) *Attorney, Agent, or Firm* — Watson Rounds; Marc D. Foodman

(57) ABSTRACT

A golf club. The golf club includes a club head. The club head includes a clubface configured to make contact with a golf ball. The golf club also includes a shaft attached to the club head. The shaft includes a center axis. The golf club further includes an elliptical grip, wherein the elliptical grip includes a center axis. The center axis of the elliptical grip is non-parallel to the center axis of the shaft.

19 Claims, 6 Drawing Sheets

ELLIPTICAL GOLF CLUB GRIP

CROSS-REFERENCE TO RELATED APPLICATIONS

This application is a continuation-in-part of, and claims the benefit of and priority to, U.S. Provisional patent application Ser. No. 13/865,708 filed on Apr. 18, 2013, which application is incorporated herein by reference in its entirety.

BACKGROUND OF THE INVENTION

When a golf club is not self-balancing, the golfer must balance the club in his/her stroke. That is, the golfer must put torque on the shaft in order to keep the face of the golf club square to the arc. This puts strain on the hands and arms of the golfer and makes it more difficult for the golfer to hit or putt successfully. Further, it means that the golfer must adjust to each golf club independently, because the amount and direction of torque required to square the golf club will vary depending on the golf club.

In order to be self-balancing a golf club must satisfy two conditions. It must "seek" square to the arc during a normal swing and it must do so when the shaft includes a forward lean. Many golf clubs claim to be self-balancing, however, they do so only when the shaft does not include forward lean. Since most golfers have forward lean in the shaft of their golf clubs, whether the golf club self-balances is irrelevant because it does not do so when in actual use.

In addition, golf club grips do not conform well to the hands of the user. In particular, club grips are round in shape. However, the hands of the user do not form a round shape. Therefore, the hands of the user must conform to the grip and there are areas of the grip with little or no pressure and areas of the grip with high pressure. Moreover, a round grip does not provide any type of tactile feedback to indicate to the user whether the club is properly aligned.

Accordingly, there is a need in the art for a golf club that will seek square even with forward lean. Further, there is a need for the golf club to avoid putting torque or strain on the user. In addition, there is a need for the club to have a grip that conforms to the hands of the user and provides tactile feedback as to the correct alignment of the golf club.

BRIEF SUMMARY OF SOME EXAMPLE EMBODIMENTS

This Summary is provided to introduce a selection of concepts in a simplified form that are further described below in the Detailed Description. This Summary is not intended to identify key features or essential characteristics of the claimed subject matter, nor is it intended to be used as an aid in determining the scope of the claimed subject matter.

One example embodiment includes a golf club. The golf club includes a club head. The club head includes a clubface configured to make contact with a golf ball. The golf club also includes a shaft attached to the club head. The shaft includes a center axis. The golf club further includes an elliptical grip, wherein the elliptical grip includes a center axis. The center axis of the elliptical grip is non-parallel to the center axis of the shaft.

Another example embodiment includes a golf club. The golf club includes a club head. The club head includes a clubface configured to make contact with a golf ball. The golf club also includes a shaft attached to the club head. The shaft includes a center axis, wherein the center axis converges with a balance point at an intersection of a lie angle radian and a lie angle axis. The golf club further includes an elliptical grip, wherein the elliptical grip includes a center axis. The center axis of the elliptical grip is non-parallel to the center axis of the shaft.

Another example embodiment includes a golf club. The golf club includes a club head. The club head includes a clubface configured to make contact with a golf ball. The golf club also includes a shaft attached to the club head. The shaft includes a center axis, wherein the center axis converges with a balance point at an intersection of a lie angle radian and a lie angle axis. The balance point is at a position ($x=x_1$, $y=\pm y_1$, $z=z_1$) in an imaginary Cartesian coordinate system defined around the club head. The imaginary Cartesian coordinate system includes an origin at the center of gravity of the club head and an x-axis defined as a horizontal line through the origin between the toe of the club head and the heel of the club head, where the clubface has a negative x location; The imaginary Cartesian coordinate system also includes a y-axis defined as a horizontal line through the origin parallel to the clubface, where the heel of the club head has a negative y location for a right-handed player. The imaginary Cartesian coordinate system further includes a z-axis defined as a vertical line through the origin, where the top of the shaft has a positive z location. The position $z_1$ is the vertical distance between the origin and the attachment surface of the club head. Thee imaginary Cartesian coordinate system additionally includes a lie angle plane defined by the center axis of the shaft and a line parallel to the x-axis, wherein the line parallel to the x-axis is offset from the x-axis a distance $z_2$ along the z-axis. The imaginary Cartesian coordinate system further includes a radian plane parallel to the x-y plane offset a distance $z_1$ from the x-y plane, where the lie angle axis includes the intersection of the lie angle plane and the radian plane. The value of $y_1$ is calculated using the equation $$y_1 = \left|\frac{z_2 - z_1}{\tan\alpha}\right|.$$

Where $\alpha$ is the lie angle of the center axis. The value of $x_1$ is calculated using the equation $$x_1 = \left|\frac{z_2 - z_1}{\tan^2\alpha}\right|.$$

The golf club further includes an elliptical grip, wherein the elliptical grip includes a center axis. The center axis of the elliptical grip is non-parallel to the center axis of the shaft.

These and other objects and features of the present invention will become more fully apparent from the following description and appended claims, or may be learned by the practice of the invention as set forth hereinafter.

BRIEF DESCRIPTION OF THE DRAWINGS

To further clarify various aspects of some example embodiments of the present invention, a more particular description of the invention will be rendered by reference to specific embodiments thereof which are illustrated in the appended drawings. It is appreciated that these drawings depict only illustrated embodiments of the invention and are therefore not to be considered limiting of its scope. The invention will be described and explained with additional specificity and detail through the use of the accompanying drawings in which.

DETAILED DESCRIPTION OF SOME EXAMPLE EMBODIMENTS

Reference will now be made to the figures wherein like structures will be provided with like reference designations. It is understood that the figures are diagrammatic and schematic representations of some embodiments of the invention, and are not limiting of the present invention, nor are they necessarily drawn to scale.

Figure 1:
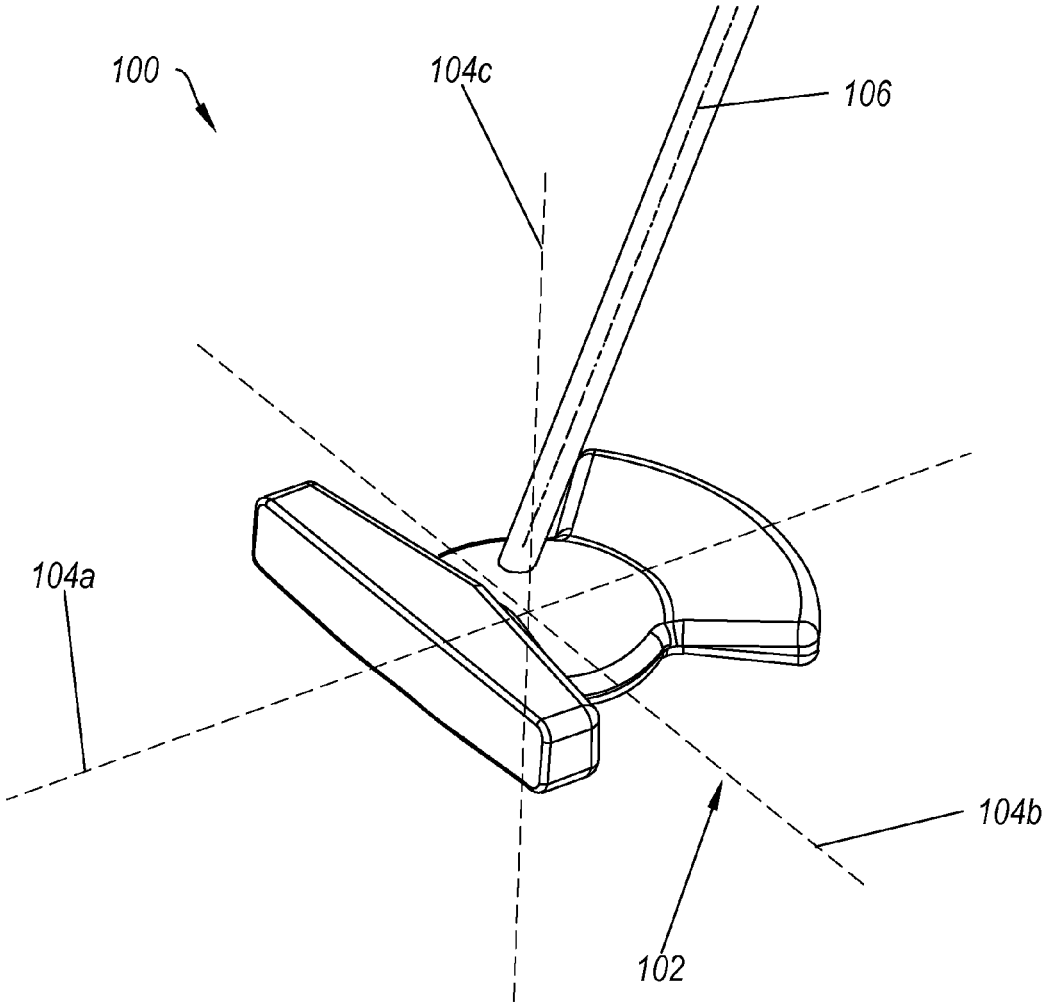
FIG. 1 illustrates an example of a self-balancing putter.

FIG. 1 illustrates an example of a self-balancing putter 100. A self-balancing putter 100 is a club used in the sport of golf to make relatively short and low-speed strokes with the intention of rolling the ball into the hole. It is differentiated from the other clubs (typically irons and woods) by a club head with a very flat, low-profile, low-loft striking face, and by other features which are only allowed on putters 100, such as bent shafts, non-circular grips, and positional guides. Putters 100 are generally used from very close distances to the cup, generally on the putting green, though certain courses have fringes and roughs near the green which are also suitable for putting. Although a putter is used as exemplary herein, one of skill in the art will appreciate that the principles disclosed herein can be used in any golf club.

FIG. 1 shows an artificial coordinate system 102 about the putter head 100. The origin on the Cartesian coordinate system 102 (i.e., the position x=0, y=0, z=0) is the center of mass (center of gravity) of the putter head 100. In physics, the center of mass of a distribution of mass in space is the unique point where the weighted relative position of the distributed mass sums to zero. I.e., the distribution of mass is balanced around the center of mass and the average of the weighted position coordinates of the distributed mass defines its coordinates.

FIG. 1 shows that the coordinate system 102 includes an x-axis 104*a*, a y-axis 104*b* and a z-axis 104*c*. The x-axis 104*a* runs through the face of the self-balancing putter. The face of the self-balancing putter 100 has a negative x position. The y-axis 104*b* is parallel to the face of the self-balancing putter 100. That is, the y-axis 104*b* is parallel to a line drawn to the center of one side of the face to the center of the other side of the face (if the clubface is symmetrical), such that the y-z plane (plane defined by the y-axis 104*b* and z-axis 104*c*) is parallel to the face of the self-balancing putter 100. The heel and toe of the self-balancing putter 100 have negative and positive y positions, respectively (vice versa for a left handed player). I.e., the heel is always closest to the player (for a right handed player this is always a negative y position, and for a left handed player this is always a positive y position). The z-axis 104*c* runs vertically through the center of gravity of the self-balancing putter 100. The top of the self-balancing putter 100 (e.g., top of the shaft, grip, etc.) has a positive z position. I.e., it is above the x-y plane.

Figure 2:
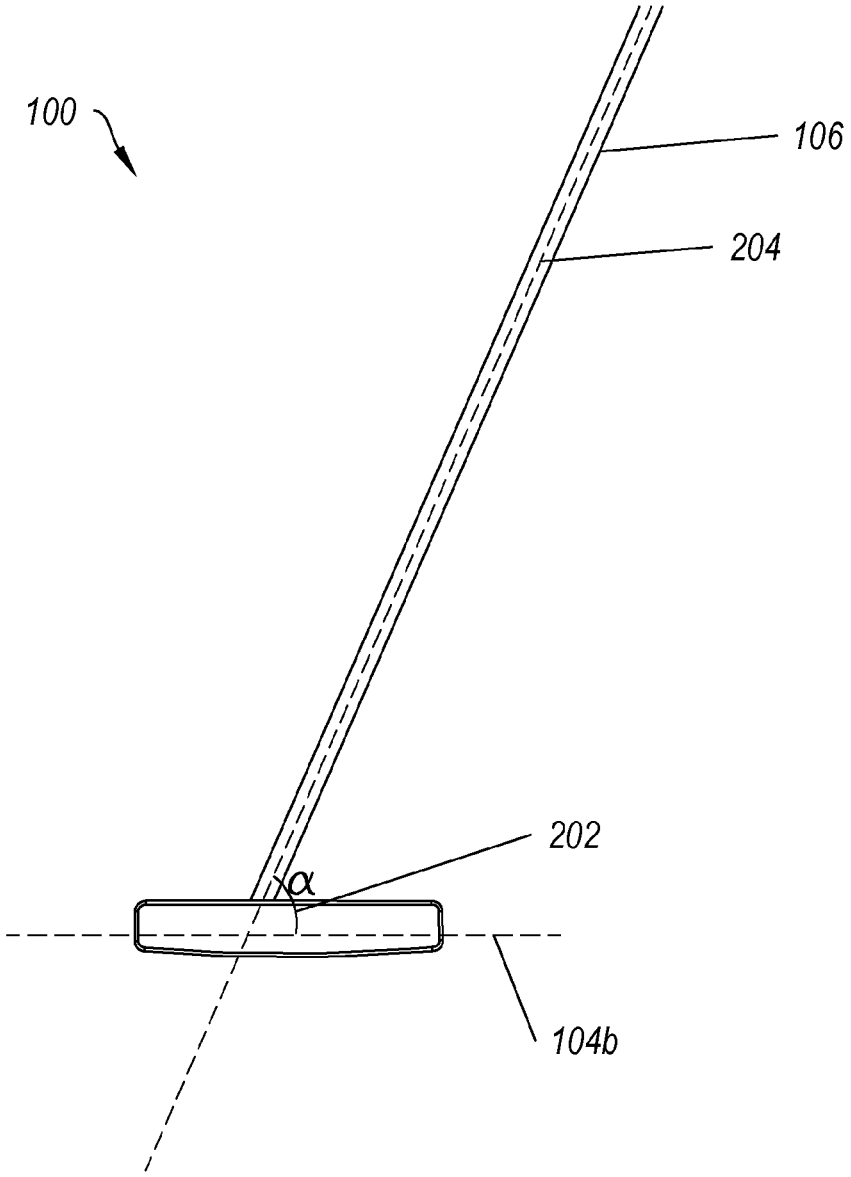
FIG. 2 illustrates the self-balancing putter of FIG. 1 looking down the y-axis at the face of the putter.

FIG. 2 illustrates the self-balancing putter 100 of FIG. 1 looking down the x-axis at the face of the putter. The lie angle 202 ("α") is defined as the angle formed between the center axis 204 of the shaft 106 and the sole, or ground line, of the self-balancing putter 100 when the self-balancing putter 100 is soled (flat on the ground) in its proper playing position (as at address). I.e., when the self-balancing putter 100 is soled on flat ground, with a straight line extending back from the heel of the self-balancing putter 100 along the ground (either the y-axis 104*b* or a line parallel to the y-axis 104*b*) the lie angle 202 is the angle from that line up to the shaft. That is, in the coordinate system 102 defined in FIG. 1, the lie angle 202 is the angle between the x-y plane and the axis 204 of the shaft 106 through the center point of the shaft 106. There is no "correct" or standard lie angle 202; the lie angle 202 that works for one golfer might be the wrong lie angle 202 for another golfer. The arc (vertical and horizontal) of a pendulum putting stroke is created by the lie angle 202 and length of the shaft. The flatter the lie angle 202 the more the same pendulum stroke appears to be inside to inside and the more upright the shaft lie angle 202 the more the putter head appears to swing back and down the line. The USGA has limited the upright lie angle 202 of a putter to be at least 10° off 90°.

Figure 3:
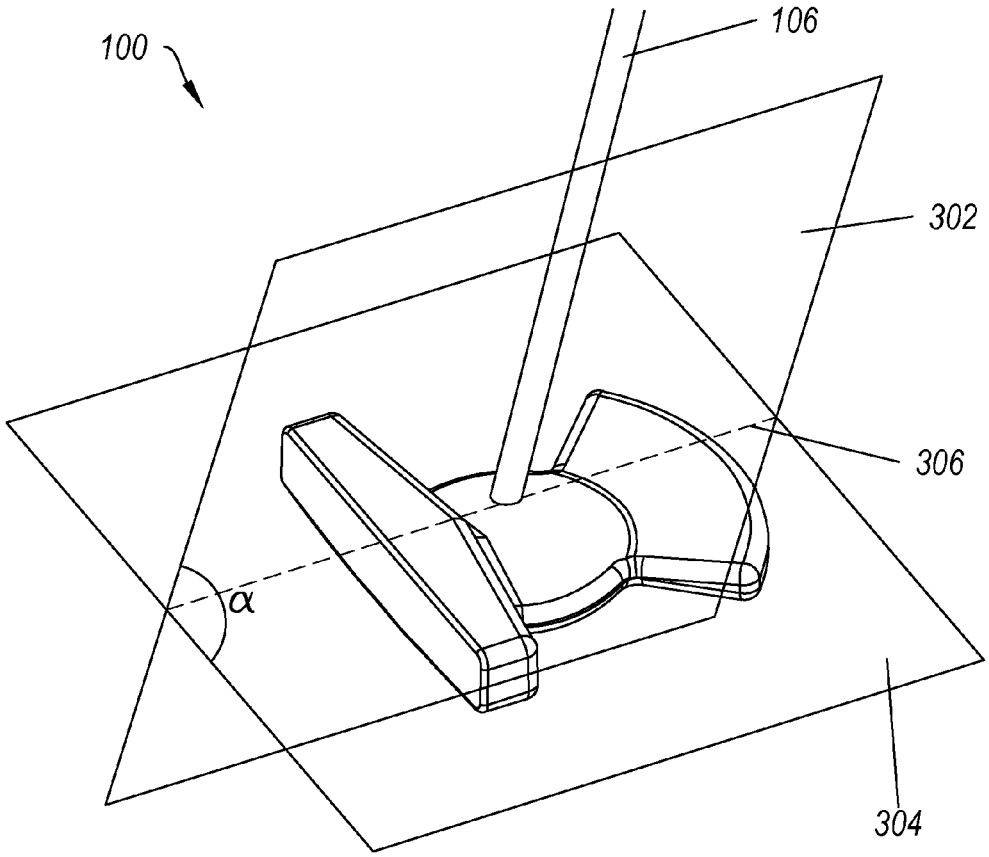
FIG. 3 illustrates a self-balancing putter with a lie angle plane.

FIG. 3 illustrates a self-balancing putter 100 with a lie angle plane 302. The lie angle plane 302 is a plane defined by the axis of the shaft 106 through the center point of the shaft and a line parallel to the x-axis 104*a* of FIG. 1 (i.e., a line parallel to the x-axis 104*a* and offset some amount along the z-axis 104*c* ("$z_1$")). That is, the lie angle plane 302 is similar to the x-y plane of FIG. 1 rotated about the x-axis 104*a* by the lie angle then offset along the z-axis 104*c* by the distance $z_1$. The value of $z_1$ can be a positive number, zero, or a negative number. I.e., the lie angle plane 302 is set at a specific distance from the center of mass. For example, the distance $z_1$ can be between 0.4 inches and 0.6 inches. E.g., the distance $z_1$ can be approximately 0.5 inches. As used in the specification and the claims, the term approximately shall mean that the value is within 10% of the stated value, unless otherwise specified. One of skill in the art will appreciate that the center line of the shaft 106 with the specified lie angle must rest in the lie angle plane 302.

A radian plane 304 is also defined in FIG. 3. The radian plane 304 is parallel to the x-y plane of FIG. 1 and offset relative to the x-y plane of FIG. 1 by some distance ("$z_2$"). I.e., it is a plane with any x or y position but with constant z position of $z_2$. The distance $z_2$ is the vertical distance from the origin to the attachment surface. The distance $z_2$ can include a negative number, zero, or positive number. One of skill in the art will appreciate that the distance between the lie angle plane 302 and the radian plane 304 along the z-axis of FIG. 1 will be: $z_1$-$z_2$.

$$z_{total}=z_1-z_2 \qquad \text{Equation 1}$$

FIG. 3 further shows a lie angle axis 306. The lie angle axis 306 is defined by the intersection of the lie angle plane 302 with the radian plane 304. That is, the lie angle axis 306 is a line parallel to the x-axis 104*a* of FIG. 1 but offset some distance along the y-axis 104*b* ("$y_1$") and a distance of $z_2$ along the z-axis 104*c*. The distance $y_1$ can be a negative number, positive number or zero and the distance $y_1$ need not be the same distance as distance $z_2$. Therefore, the position of the lie angle axis 306 will have any x value and is defined by the coordinates ($y=y_1$, $z=z_2$). One of skill in the art will appreciate that since the z-axis 104*c* of FIG. 1, the lie angle plane 302 and the radian plane 304 form a right triangle with the angle between the lie angle plane 302 and the radian plane 304 having a value of $\alpha$, the value of $y_1$ can be calculated using the formula:

$$\tan\alpha = \frac{z_{total}}{y_1} \xrightarrow{yields} y_1 = \left|\frac{z_{total}}{\tan\alpha}\right| \quad \text{Equation 2}$$

Figure 4:
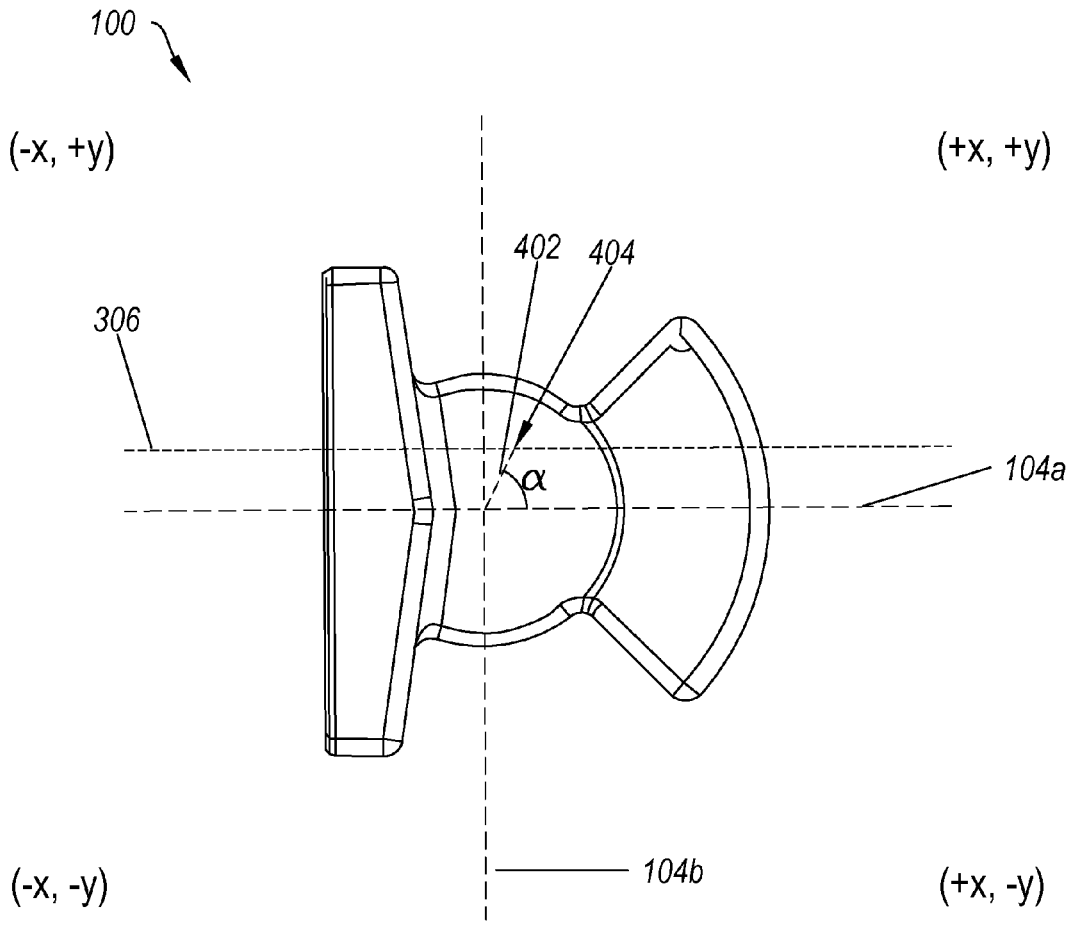
FIG. 4 illustrates a top view of the self-balancing putter.

FIG. 4 illustrates a top view (i.e., down the z-axis) of the self-balancing putter 100. For simplicity's sake, the shaft of the putter is not shown in FIG. 4. In addition, the quadrants of the x-y plane are labeled. The z-axis is not shown but passes through FIG. 4 as can be determined from FIG. 1.

FIG. 4 shows a lie angle radian 402. The lie angle radian 402 origin is the z-axis (x=0, y=0) on the radian plane 304. The angle relative to the x-axis 104*a* of the lie angle radian 402 is always approximately equal to the lie angle. The lie angle radian 402 terminates at the lie angle axis 306. That is, the lie angle radian 402 is similar to the x-axis, offset along the z-axis by the same distance as the radian plane ($z_2$) and rotated by the lie angle (or the y-axis rotated by 90 degrees minus the lie angle) in a direction from the positive x-axis 104*a* to the positive y-axis 104*b* (or the negative y-axis 104*b* for a left-handed player). The lie angle radian 402 always terminates at the lie angle axis at a position ($x=x_1$, $y=\pm y_1$) (the absolute value in Equation 2 ensures that the value of $y_1$ is always positive regardless of the z value). Right-handed players always have the lie angle radian 402 in the +x, +y quadrant, and left-handed players always have the lie angle radian 402 in the +x, −y quadrant. One of skill in the art will appreciate that, because the x-axis 104*a*, lie angle radian and line segment of distance $y_1$ can form a right triangle, the value of $x_1$ can be calculated using the formula:

$$\tan\alpha = \frac{y_1}{x_1} \xrightarrow{yields} x_1 = \frac{y_1}{\tan\alpha} \quad \text{Equation 3}$$

Substituting Equation 2 into Equation 3 yields:

$$x_1 = \left|\frac{\frac{z_{total}}{\tan\alpha}}{\tan\alpha}\right| = \left|\frac{z_{total}}{\tan^2\alpha}\right| \text{ or} \quad \text{Equation 4}$$

$$x_1 = \left|\frac{y_1}{\frac{z_{total}}{y_1}}\right| = \left|\frac{y_1^2}{z_{total}}\right|$$

The shaft center line always originates at a balance point 404 defined as the intersection of the lie angle radian 402 and the lie angle axis 306 (i.e., position $x=x_1$, $y=\pm y_1$, $z=z_2$). That is, the axis of the shaft through the center of the shaft (the same axis used to measure the lie angle), the lie angle axis 306 and the lie angle radian 402 all converge at a single point. One of skill in the art will appreciate that the shaft can be rotated about this point. I.e., the axis of the shaft can be moved within the lie angle plane 302 (otherwise, the lie angle would be changed) as long as the balance point 404 remains the same. This can allow the self-balancing putter 100 to be customized to the user based on the lie angle preferred by the user. The balance point is configured to make the club face seek square when making contact with the golf ball. As used in the specification and the claims, the phrase "configured to" denotes an actual state of configuration that fundamentally ties recited elements to the physical characteristics of the recited structure. As a result, the phrase "configured to" reaches well beyond merely describing functional language or intended use since the phrase actively recites an actual state of configuration.

One of skill in the art will appreciate that the shaft may, but is not required to, attach to the balance point 404 (even though the center line of the shaft will still intersect with the balance point 404). In particular, the shaft may have a bend or curve near the balance point 404. Thus the lie angle axis 306 of FIG. 3 is not necessarily contiguous with the shaft. Additionally or alternatively, the shaft can be attached to a hosel. The hosel is a portion of the self-balancing putter 100 head to which the shaft attaches. Though largely ignored by players, hosel design is integral to the balance, feel and power of a self-balancing putter 100. A hosel can be a separate piece attached to the club head and can connect to the shaft internally or externally and it can be bent. In addition the rules of golf consider a bend in the shaft to be a type of hosel.

Because the balance point 404 is the intersection of the lie angle axis 306 and the lie angle radian 402, the putter head will be balanced to match the lie angle of the shaft relative to the ground line. This is critical to keep the face square to the arc of the stroke without any outside influences or any torsion forces from the golfer's hands.

The balance point 404 at the intersection of the lie angle axis 306 and the lie angle radian 402, with or without forward shaft lean, will keep the putter face perpendicular to the arc that the lie angle and length creates throughout the back swing, transition and forward stroke and impact. If the shaft attaches at a different point, the self-balancing putter 100 is not swung on the lie angle that the shaft creates (which is limited to 80° upright, as described above). This eliminates the possibility of a toe down or variations thereof, toe up or variations thereof, face balanced or variations thereof or face straight down self-balancing putter 100 ever being able to remain naturally balanced face on and perpendicular to the arc the self-balancing putter 100 swings on without outside influence from the hands.

The benefit of this balancing is to keep the face square to the arc without tension or manipulation of the large and small muscles in the arms and hands. Being able to reduce tension in your hands and arms allows a golfer to focus on acceleration for proper distance control without also thinking about face angle (direction and path) at impact. I.e., by inserting or aligning the shaft not directly above the center of mass it creates an extra lever that resists twisting on any strike and in fact self corrects without any outside influence from your hands. In other words, the balance point 404 ensures that the self-balancing putter 100 seeks 'square' with a forward shaft lean at address and continues to seek square at any point in the back swing, down swing and impact.

Figure 5:
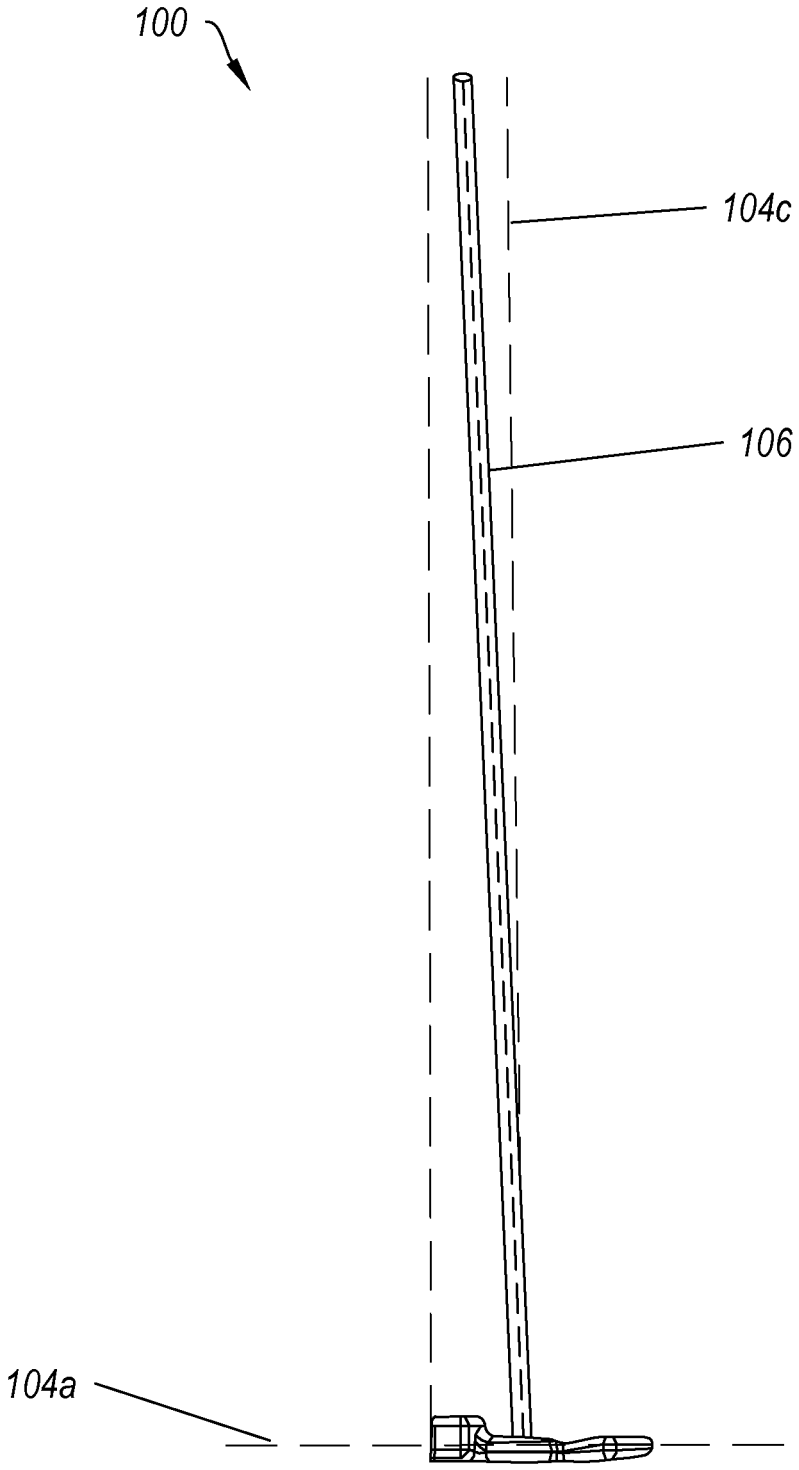
FIG. 5 illustrates a side view of the self-balancing putter.

FIG. 5 illustrates a side view (i.e., down the y-axis) of the self-balancing putter 100. FIG. 5 shows a forward lean of the shaft 106. The shaft 106 lies entirely in the lie angle plane 302 of FIG. 3. I.e., the shaft 106 is in the lie angle plane 302 and starts 90 degrees to the lie angle axis (which is parallel to the x-axis 104*a*). The shaft 106 can only be tilted from this position toward the face of the self-balancing putter 100 under current golf rules. This tilt is called forward lean and typically is moved forward so the top center line end point of the shaft is approximately 0.75 inches behind the face of the self-balancing putter 100 (about 1.7 degrees) but is not limited to that.

Figure 6A:
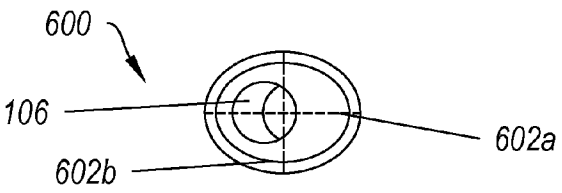
FIG. 6A illustrates a bottom view of the example of an elliptical grip.
Figure 6B:
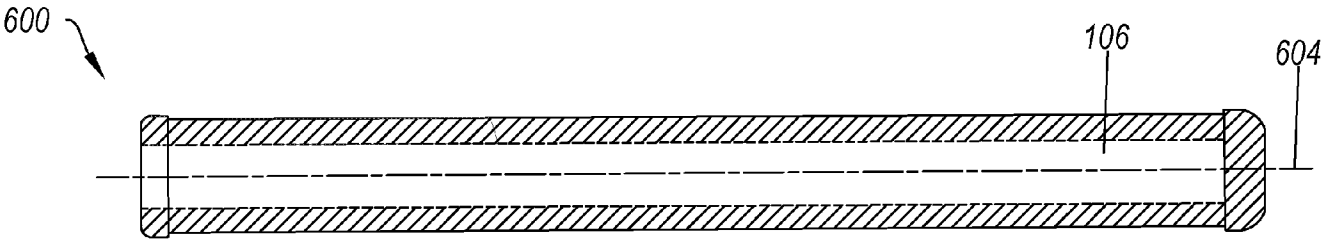
FIG. 6B illustrates a side view of the example of an elliptical grip.
Figure 6C:
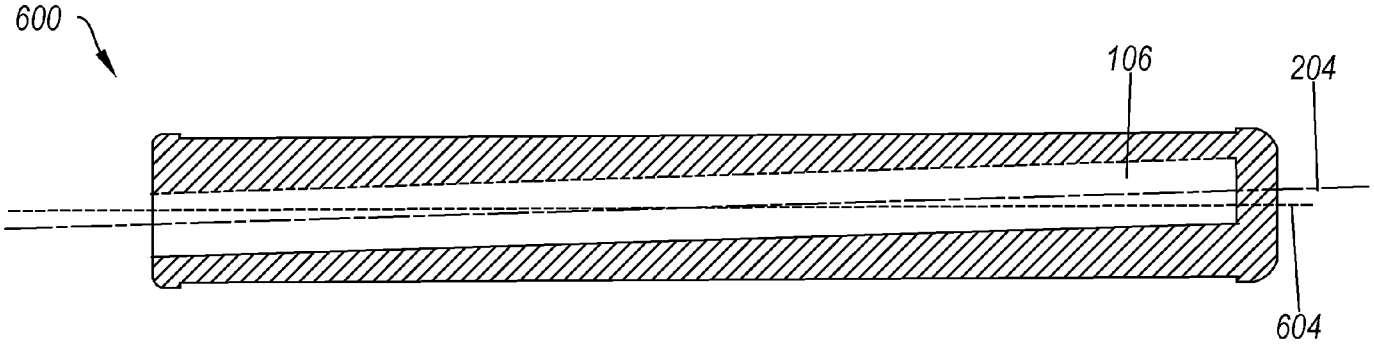
FIG. 6C illustrates a front view of the example of an elliptical grip.

FIGS. 6A, 6B and 6C illustrate an example of an elliptical grip 600. FIG. 6A illustrates a bottom view of the example of an elliptical grip; FIG. 6B illustrates a side view of the example of an elliptical grip; and FIG. 6C illustrates a front view of the example of an elliptical grip. The elliptical grip 600 can provide a better grip surface for a user. I.e., the elliptical grip 600 better conforms to the hand of the user during actual use. Additionally or alternatively, the elliptical grip 600 helps the putter to self-align better. That is, the elliptical grip 600 allows the club to be aligned in the user's hand more naturally, providing for a more reproducible stance and, therefore, more consistent putting.

In mathematics, an ellipse is a curve on a plane surrounding two focal points such that a straight line drawn from one of the focal points to any point on the curve and then back to the other focal point has the same length for every point on the curve. The shape of an ellipse (how "elongated" it is) is represented by its eccentricity which for an ellipse can be any number from 0 (the limiting case of a circle) to arbitrarily close to but less than 1. Ellipses are the closed type of conic section: a plane curve that results from the intersection of a cone by a plane.

FIG. 6 shows that the elliptical grip 600 include a major axis 602*a* and a minor axis 602*b* (collectively "axes 602") which intersect at a center axis 604. Ellipses have two mutually perpendicular axes about which the ellipse is symmetric. These axes intersect at the center axis 604 of the ellipse due to this symmetry. The larger of these two axes, which corresponds to the largest distance between antipodal points on the ellipse, is called the major axis 602*a* or transverse diameter. The smaller of these two axes, and the smallest distance across the ellipse, is called the minor axis 602*b* or conjugate diameter. One of skill in the art will appreciate that the ellipse can include one or more flat sections. I.e., a portion of the elliptical grip 600 can have a portion of the ellipse which is linear rather than curved.

The major axis 602*a* can be perpendicular to the club face (i.e., parallel to the x-z plane defined by the x-axis 104*a* and the z-axis 104*c* of FIG. 1). The maximum diameter of the major axis 602*a* is 1.750 inches under current USGA rules. Typically, the major axis 602*a* will be 1.15 inches and 1.75 inches. For example, the major axis 602*a* can be approximately 1.45 inches. This size can be critical to fit comfortably within the hand of the user.

The minor axis 602*b* can be parallel to the club face (i.e., parallel to the y-z plane defined by the y-axis 104*b* and the z-axis 104*c* of FIG. 1). Typically, the minor axis 602*b* will be between 0.95 inches and 1.35 inches. For example, the minor axis 602*b* can be approximately 1.15 inches long. This size can be critical to fit comfortably within the hand of the user.

FIG. 6 shows that center axis 204 of the shaft 106 can be offset relative to the center axis 604 of the elliptical grip 600. That is, the center axis 204 and the center axis 604 are non-parallel to one another. I.e., the center axis 204 is not aligned with or parallel to, but may intersect, the center axis 604. For example, the center axis 604 and the center axis 204 can intersect approximately halfway between the top and the bottom of the elliptical grip. For example, if the elliptical grip is approximately 10.5 inches long, then the center axis 204 and the center axis 604 can intersect approximately 5.25 inches from the bottom of the elliptical grip 600. The angle of the center axis 604 relative to the center axis 204 can be between 1.2 degrees and 1.8 degrees. For example, the angle of the center axis relative to the center axis 204 can be approximately 1.5 degrees. The center axis 204 may be on the major axis 602*a* (in that case the center axis 204 and the center axis 604 coincide with one another when viewed from the side, such as in FIG. 6B). I.e., each point of the center axis 604 where the shaft 106 is within the elliptical grip 600 may be on the major axis 604.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A golf club, the golf club comprising:
a club head, wherein the club head includes:
a clubface configured to make contact with a golf ball;
a shaft attached to the club head, wherein the shaft includes a center axis; and
an elliptical grip, wherein the elliptical grip includes a center axis;
wherein the center axis of the elliptical grip is non-parallel to the center axis of the shaft; and wherein the club has a balance point at an intersection of a lie angle radian and a lie angle axis and at this intersection the balance point and the center axis of the shaft converge.

2. The golf club of claim 1, wherein the center axis of the shaft intersects the center axis of the elliptical grip.

3. The golf club of claim 2, wherein the intersection of the center axis of the shaft and the center axis of the elliptical grip is approximately halfway between the top and the bottom of the elliptical grip.

4. The golf club of claim 2, wherein the angle between of the center axis of the shaft relative to the center axis of the elliptical grip is between 1.2 degrees and 1.8 degrees.

5. The golf club of claim 4, wherein the angle between of the center axis of the shaft relative to the center axis of the elliptical grip is approximately 1.5 degrees.

6. The golf club of claim 1, wherein the major axis of the elliptical grip is between 1.15 inches and 1.75 inches.

7. The golf club of claim 6, wherein the major axis of the elliptical grip is approximately 1.45 inches.

8. The golf club of claim 1, wherein the minor axis of the elliptical grip is between 0.95 inches and 1.35 inches.

9. The golf club of claim 6, wherein the major axis of the elliptical grip is approximately 1.15 inches.

10. The golf club of claim 1, wherein the center axis of the shaft includes the axis of the shaft through the central portion of the shaft.

11. The golf club of claim 1, wherein the lie angle radian originates at a position offset vertically relative to the center of gravity of the club head.

12. The golf club of claim 1, wherein the angle of the lie angle radian relative to the clubface is approximately equal to 90 degrees minus the lie angle of the shaft.

13. The golf club of claim 1, wherein the lie angle axis includes a horizontal line perpendicular to the clubface.

14. A self-balancing golf club comprising:
a club head, wherein the club head includes:
a clubface configured to make contact with a golf ball;
a shaft attached to the club head, wherein the shaft includes:
a center axis, wherein the center axis converges with a balance point at an intersection of:
a lie angle radian; and
a lie angle axis; and
an elliptical grip, wherein the elliptical grip includes a center axis;
wherein the center axis of the elliptical grip is non-parallel to the center axis of the shaft.

15. The self-balancing golf club of claim 14, wherein the balance point is at a position ($x=x_1$, $y=\pm y_1$, $z=z_1$) in an imaginary Cartesian coordinate system defined around the club head, wherein the imaginary Cartesian coordinate system includes:

an origin at the center of gravity of the club head;

an x-axis defined as a horizontal line through the origin between the toe of the club head and the heel of the club head;

wherein the clubface has a negative x location;

a y-axis defined as a horizontal line through the origin parallel to the clubface; and wherein the heel of the club head has a negative y location for a right-handed player;

a z-axis defined as a vertical line through the origin;

wherein the top of the shaft has a positive z location;

wherein the position $z_1$ is the vertical distance between the origin and the attachment surface of the club head.

16. The self-balancing golf club of claim 15, wherein the imaginary Cartesian coordinate system includes:

a lie angle plane defined by:

the center axis of the shaft and a line parallel to the x-axis, wherein the line parallel to the x-axis is offset from the x-axis a distance $z_2$ along the z-axis; and a radian plane parallel to the x-y plane offset a distance $z_1$ from the x-y plane;

wherein the lie angle axis includes the intersection of the lie angle plane and the radian plane.

17. The self-balancing golf club of claim 15, wherein the distance $z_1$ is approximately 0.5 inches.

18. A self-balancing golf club comprising:

a club head, wherein the club head includes:

a clubface configured to make contact with a golf ball;

a shaft attached to the club head, wherein the shaft includes:

a center axis, wherein the center axis converges with a balance point at an intersection of:

a lie angle radian;

a lie angle axis;

at a position ($x=x_1$, $y=\pm y_1$, $z=z_1$) in an imaginary Cartesian coordinate system defined around the club head, wherein the imaginary Cartesian coordinate system includes:

an origin at the center of gravity of the club head;

an x-axis defined as a horizontal line through the origin between the toe of the club head and the heel of the club head;

wherein the clubface has a negative x location;

a y-axis defined as a horizontal line through the origin parallel to the clubface;

wherein the heel of the club head has a negative y location for a right-handed player;

a z-axis defined as a vertical line through the origin;

wherein the top of the shaft has a positive z location;

wherein the position $z_1$ is the vertical distance between the origin and the attachment surface of the club head; and a lie angle plane defined by:

the center axis of the shaft and a line parallel to the x-axis, wherein the line parallel to the x-axis is offset from the x-axis a distance $z_2$ along the z-axis; and a radian plane parallel to the x-y plane offset a distance $z_1$ from the x-y plane;

wherein the lie angle axis includes the intersection of the lie angle plane and the radian plane wherein the value of $y_1$ is calculated using the equation:

$$y_1 = \left|\frac{z_2 - z_1}{\tan\alpha}\right|;$$

where:

a is the lie angle of the center axis; and wherein the value of $x_1$ is calculated using the equation:

$$x_1 = \left|\frac{z_2 - z_1}{\tan^2\alpha}\right|;$$

and an elliptical grip, wherein the elliptical grip includes a center axis;

wherein the center axis of the elliptical grip is non-parallel to the center axis of the shaft.

19. The self-balancing golf club of claim 18 further comprising a forward lean, wherein the forward lean of the shaft relative to the club head is approximately 0.75 inches behind the clubface.

* * * * *